US007055474B2

(12) United States Patent
Machida et al.

(10) Patent No.: US 7,055,474 B2
(45) Date of Patent: Jun. 6, 2006

(54) VARIABLE VALVE CONTROL APPARATUS FOR INTERNAL COMBUSTION ENGINE AND METHOD THEREOF

(75) Inventors: Kenichi Machida, Atsugi (JP); Takeshi Etou, Chigasaki (JP)

(73) Assignees: Hitachi, Ltd., Tokyo (JP); Nissan Motor Co., Ltd., Yokohama (JP)

( * ) Notice: Subject to any disclaimer, the term of this patent is extended or adjusted under 35 U.S.C. 154(b) by 406 days.

(21) Appl. No.: 10/725,493

(22) Filed: Dec. 3, 2003

(65) Prior Publication Data

US 2004/0107929 A1 Jun. 10, 2004

(30) Foreign Application Priority Data

Dec. 3, 2002 (JP) ..... 2002-351565

(51) Int. Cl.
*F01L 1/34* (2006.01)

(52) U.S. Cl. ..... 123/90.16; 123/90.15; 123/90.31

(58) Field of Classification Search ..... 123/90.15, 123/90.16, 90.17, 90.31
See application file for complete search history.

(56) References Cited

U.S. PATENT DOCUMENTS 6,260,524 B1 7/2001 Wachi
6,691,022 B1 * 2/2004 Takemura et al. ..... 701/109
2002/0100440 A1 8/2002 Takahashi et al.
2004/0103887 A1 6/2004 Machida

FOREIGN PATENT DOCUMENTS

| | | | |
|---|---|---|---|
| DE | 100 26 990 | A1 | 6/2001 |
| JP | 6-272580 | A | 9/1994 |
| JP | 9-195840 | A | 7/1997 |
| JP | 2001-12262 | A | 1/2001 |
| JP | 2001-41013 | A | 2/2001 |
| JP | 2001-164951 | A | 6/2001 |

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

When controlled variable in a variable valve event and lift mechanism is made to be a predetermined value, requested closing timing at which a target air amount can be obtained and requested opening timing at which a target residual gas rate can be obtained are calculated, and the controlled variable is changed in stepwise until an absolute value of a deviation between a requested operating angle at the requested closing timing and the requested opening timing, and an operating angle corresponding to the controlled variable, reaches a predetermined value or less, so that the controlled variable of the time when the absolute value of the deviation reaches the predetermined value or less is set to a desired value.

19 Claims, 16 Drawing Sheets

VARIABLE VALVE CONTROL APPARATUS FOR INTERNAL COMBUSTION ENGINE AND METHOD THEREOF

FIELD OF THE INVENTION

The present invention relates to a variable valve control apparatus and a variable valve control method for an internal combustion engine, and in particular to a technology for controlling a variable valve event and lift mechanism that successively varies an operating angle and valve lift of an intake valve, according to a target intake air amount and a target residual gas rate.

RELATED ART OF THE INVENTION

Heretofore, there has been known an apparatus in which a target torque is set based on an accelerator opening and an engine rotation speed, and an operating characteristic of an intake valve is varied so that a target intake air amount equivalent to the target torque can be obtained (refer to Japanese Unexamined Patent Publication No. 6-272580).

Further, there has also been known a variable valve event and lift mechanism that successively varies valve lifts of engine valves together with operating angles of the engine valves (refer to Japanese Unexamined Patent Publication No. 2001-012262).

The above mentioned variable valve event and lift mechanism is the one in which an operating angle is fixed mechanically according to a valve lift amount, and if the valve lift amount is varied, the operating angle is also varied with the variation of the valve lift amount.

In the case where an intake air amount and a residual gas rate are controlled, by using the variable valve event and lift mechanism to vary the operating angle and valve lift of the intake valve, the following problem is caused.

If the operating angle and valve lift of the intake valve are fixed, requested closing timing of the intake valve is determined based on a request to the intake air amount and also requested opening timing of the intake valve is determined based on a request to the residual gas rate.

However, if the operating angle obtained based on the requested opening/closing timing does not coincide with the operating angle being a basis in the calculation of the requested opening/closing timing, actually, it is impossible to meet the requests to intake air amount and residual gas rate.

On the other hand, it is hard to estimate the operating angle and valve lift which meet the request to intake air amount and the request to residual gas amount simultaneously.

Accordingly, it is impossible to easily calculate a desired value of the variable valve event and lift mechanism, which meets the request to intake air amount and the request to residual gas rate simultaneously.

SUMMARY OF THE INVENTION

It is therefore an object of the present invention to enable the simple calculation of an operating angle and valve lift of an intake valve which meet a request to an intake air amount and a request to a residual gas rate simultaneously.

In order to accomplish the above-mentioned object, according to the present invention, provided that controlled variable of a variable valve event and lift mechanism is a predetermined value, requested opening timing and requested closing timing of an intake valve are calculated, and also a requested operating angle is calculated based on the requested opening timing and the requested closing timing.

Then, until an absolute value of a deviation between an operating angle corresponding to the controlled variable and the requested operating angle reaches a predetermined value or less, the controlled variable is updated according to the deviation, and the calculations of the requested opening timing, the requested closing timing and the deviation are repetitively performed based on the post-updated controlled variable.

Thereafter, the controlled variable of the time when the absolute value of the deviation is the predetermined value or less is set to a desired value, to control the variable valve event and lift mechanism based on the desired value.

The other objects and features of the invention will become understood from the following description with reference to the accompanying drawings.

DESCRIPTION OF THE PREFERRED EMBODIMENT

Figure 1:
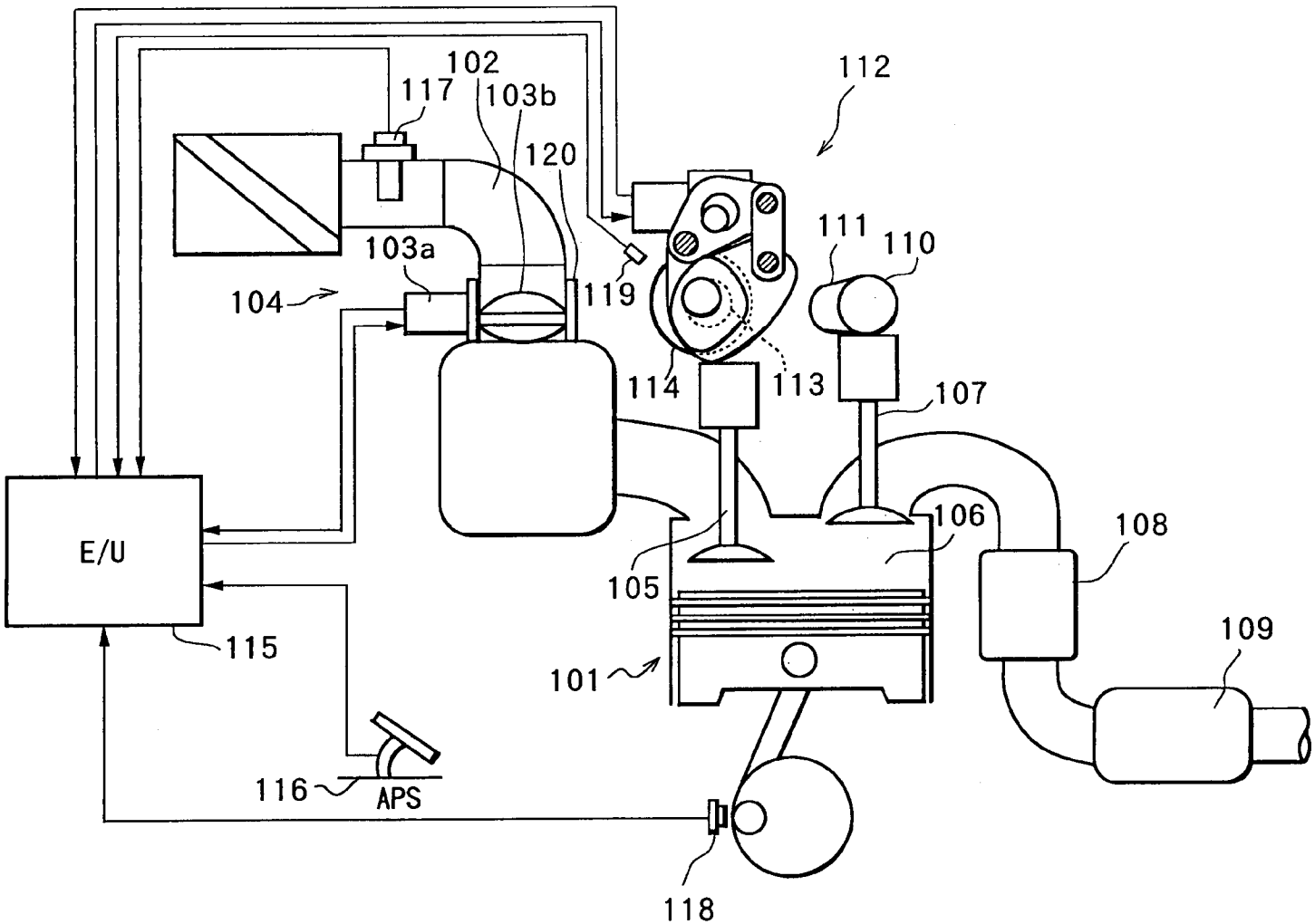
FIG. 1 is a diagram of a system structure of an internal combustion engine in an embodiment.

FIG. 1 is a diagram of a system structure of an internal combustion engine for vehicle comprising a variable valve mechanism according to the present invention.

In FIG. 1, in an intake passage 102 of an internal combustion engine 101, an electronically controlled throttle 104 is disposed for driving a throttle valve 103*b* to open and close by a throttle motor 103*a*.

Intake air is introduced into a combustion chamber 106 via electronically controlled throttle 104 and an intake valve 105.

A combusted exhaust gas is discharged from combustion chamber 106 via an exhaust valve 107 to an exhaust passage.

Then, the combusted exhaust gas is purified by an exhaust purification catalyst 108 and thereafter, emitted into the atmosphere via a muffler 109.

Exhaust valve 107 is driven by a cam 111 axially supported by an exhaust side camshaft 110, while maintaining fixed valve lift amount, valve operating angle and valve opening/closing timing.

A valve lift and a valve operating angle of intake valve 105 are varied successively by a variable valve event and lift mechanism 112.

On an end portion of an intake side camshaft 113, there is disposed a variable valve timing mechanism 114 that varies successively a center phase of the operating angle of intake valve 105 by changing a rotation phase of intake side camshaft 113 relative to a crankshaft.

A control unit 115 incorporating therein a microcomputer, receives various detection signals from an accelerator opening sensor 116 detecting an accelerator opening, an air flow meter 117 detecting an intake air amount Qa, a crank angle sensor 118 detecting a rotation of the crankshaft, a cam sensor 119 detecting a rotation of intake side camshaft 113, and a throttle sensor 120 detecting an opening of throttle valve 103*b*.

Then, control unit 115 adjusts an amount of working medium of engine 101 by controlling variable valve event and lift mechanism 112 and variable valve timing mechanism 114.

Further, control unit 115 controls the opening of throttle valve 103*b* so that a fixed negative pressure is generated.

Here, the structure of variable valve event and lift mechanism 112 will be described.

Figure 2:
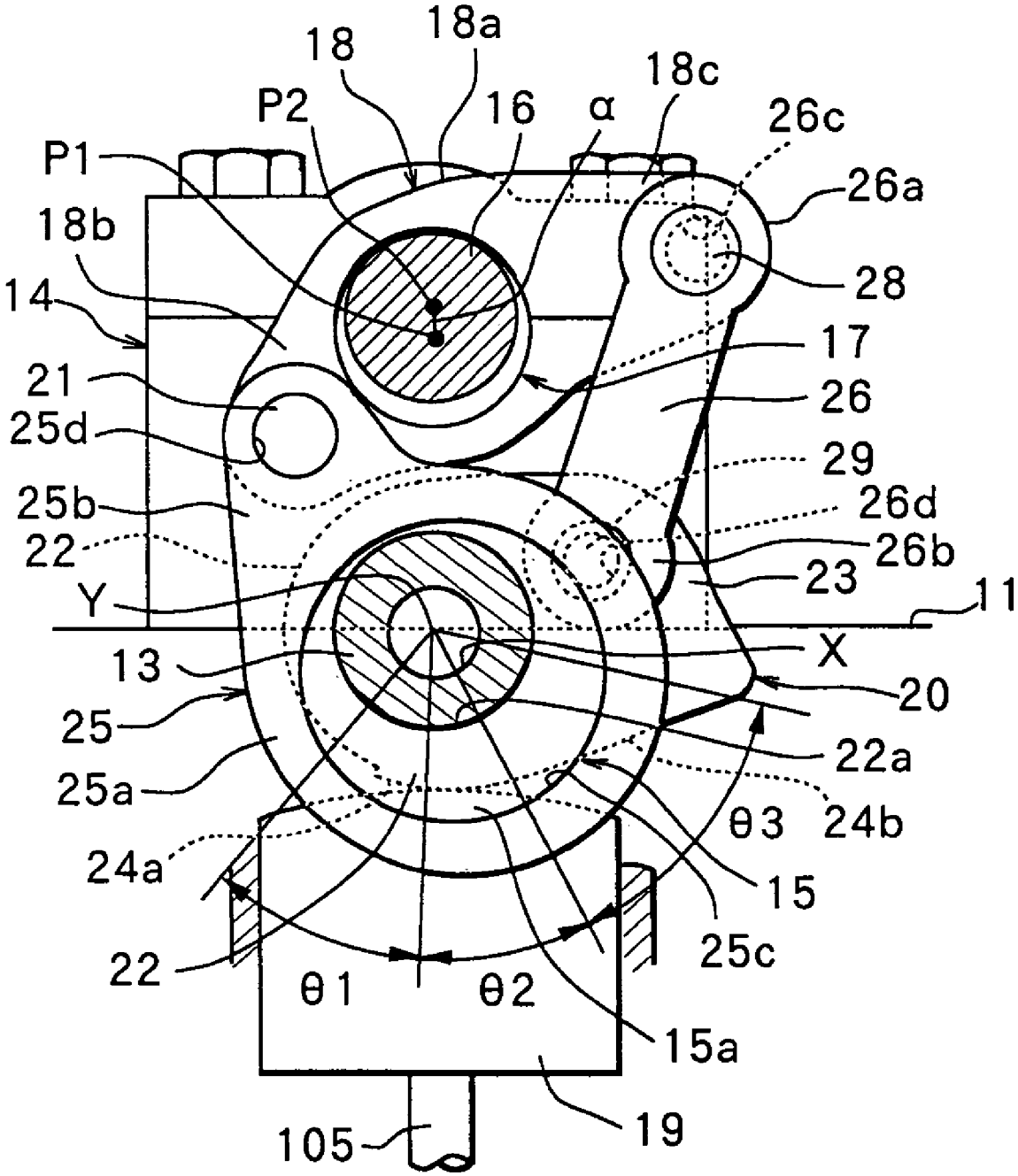
FIG. 2 is a cross section view showing a variable valve event and lift mechanism (A—A cross section of FIG. 3).
Figure 3:
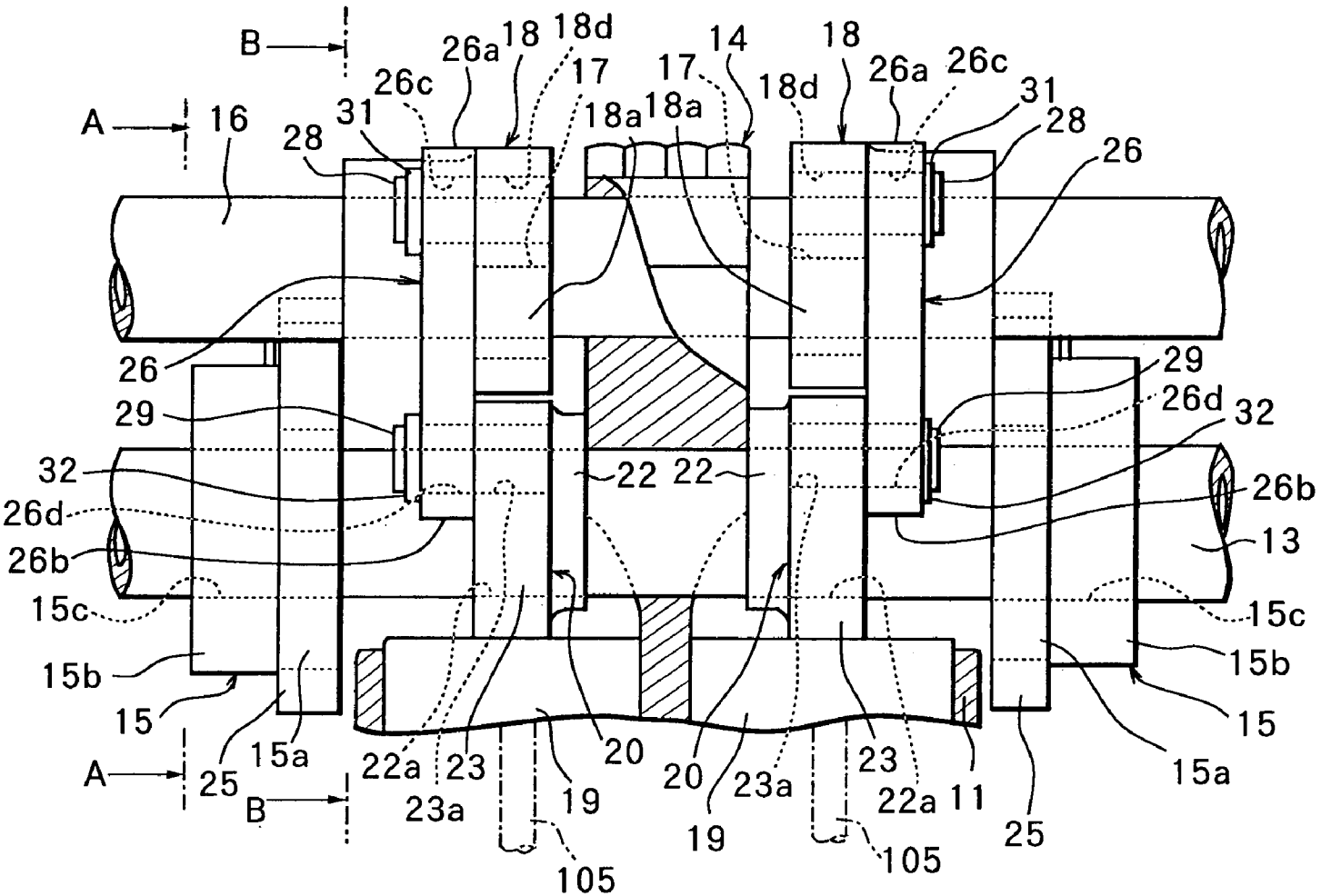
FIG. 3 is a side elevation view of the variable valve event and lift mechanism.
Figure 4:
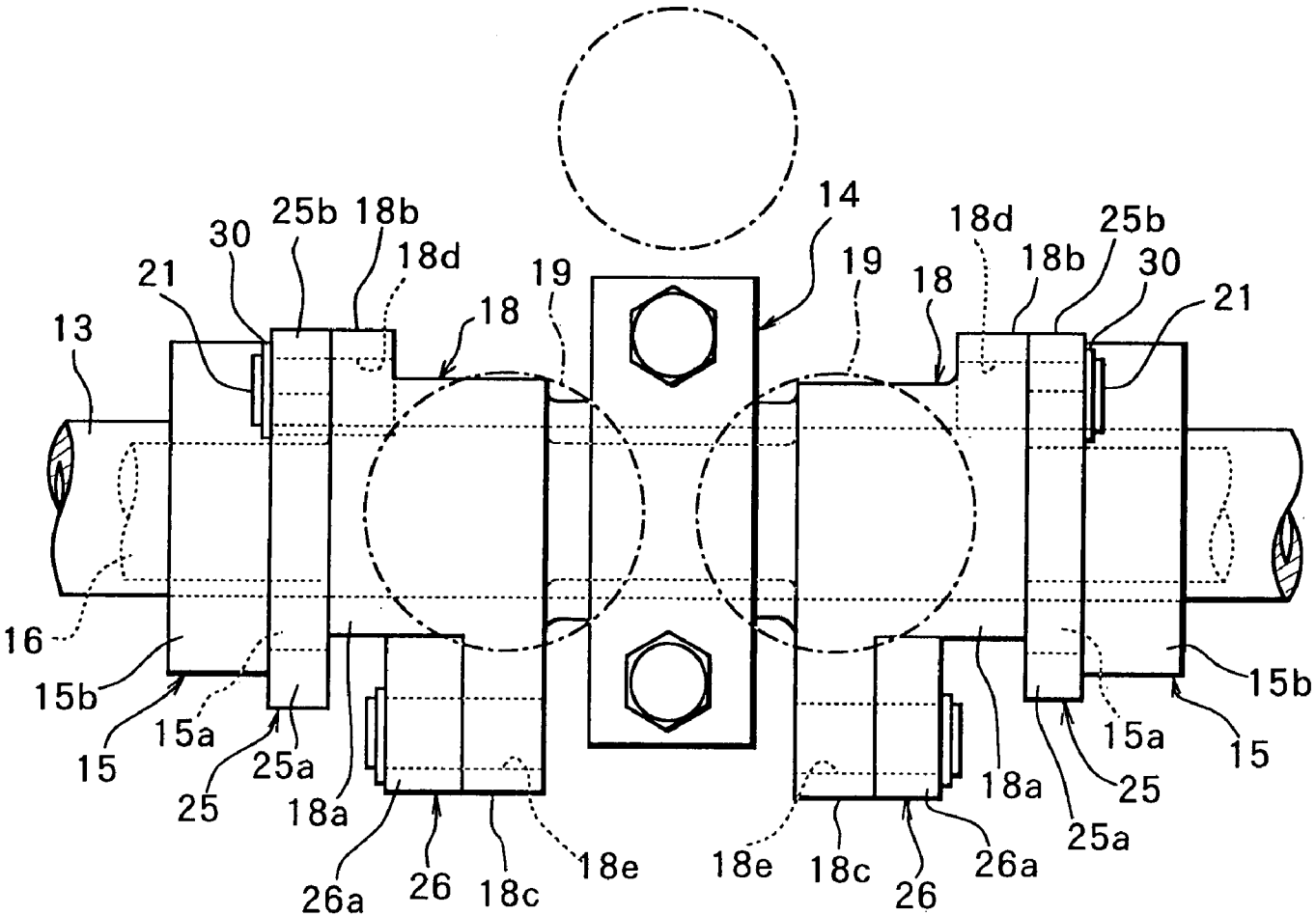
FIG. 4 is a top plan view of the variable valve event and lift mechanism.

Variable valve event and lift mechanism 112, as shown in FIG. 2 to FIG. 4, includes a pair of intake valves 105, 105, a hollow camshaft 13 rotatably supported by a cam bearing 14 of a cylinder head 11, two eccentric cams 15, 15 axially supported by camshaft 13, a control shaft 16 rotatably supported by cam bearing 14 and arranged at an upper position of camshaft 13, a pair of rocker arms 18, 18 swingingly supported by control shaft 16 through a control cam 17, and a pair of swing cams 20, 20 disposed independently from each other to upper end portions of intake valves 105, 105 through valve lifters 19, 19, respectively.

Eccentric cams 15, 15 are connected with rocker arms 18, 18 by link arms 25, 25, respectively, and rocker arms 18, 18 are connected with swing cams 20, 20 by link members 26, 26.

Figure 5:
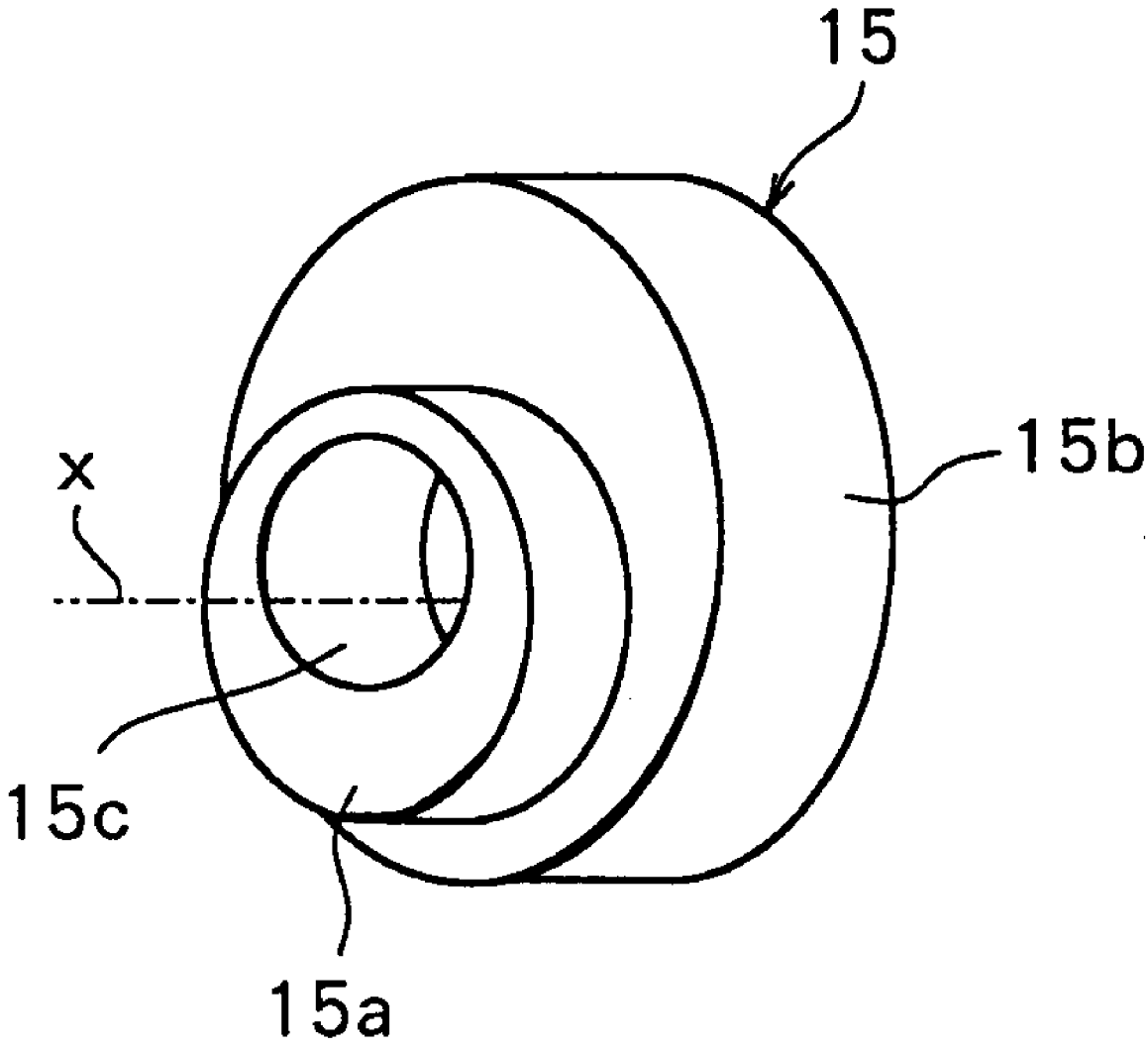
FIG. 5 is a perspective view showing an eccentric cam for use in the variable valve event and lift mechanism.

Each eccentric cam 15, as shown in FIG. 5, is formed in a substantially ring shape and includes a cam body 15*a* of small diameter, a flange portion 15*b* integrally formed on an outer surface of cam body 15*a*. A camshaft insertion hole 15*c* is formed through the interior of eccentric cam 15 in an axial direction, and also a center axis X of cam body 15*a* is biased from a center axis Y of camshaft 13 by a predetermined amount.

Eccentric cams 15, 15 are pressed and fixed to camshaft 13 via camshaft insertion holes 15*c* at outsides of valve lifters 19, 19, respectively, so as not to interfere with valve lifters 19, 19. Also, outer peripheral surfaces 15*d*, 15*d* of cam body 15*a* are formed in the same cam profile.

Each rocker arm 18, as shown in FIG. 4, is bent and formed in a substantially crank shape, and a central base portion 18*a* thereof is rotatably supported by control cam 17.

A pin hole 18*d* is formed through one end portion 18*b* which is formed to protrude from an outer end portion of base portion 18*a*. A pin 21 to be connected with a tip portion of link arm 25 is pressed into pin hole 18*d*. A pin hole 18*e* is formed through the other end portion 18*c* which is formed to protrude from an inner end portion of base portion 18*a*. A pin 28 to be connected with one end portion 26*a* (to be described later) of each link member 26 is pressed into pin hole 18*e*.

Control cam 17 is formed in a cylindrical shape and fixed to a periphery of control shaft 16. As shown in FIG. 2, a center axis P1 position of control cam 17 is biased from a center axis P2 position of control shaft 16 by $\alpha$.

Figure 6:
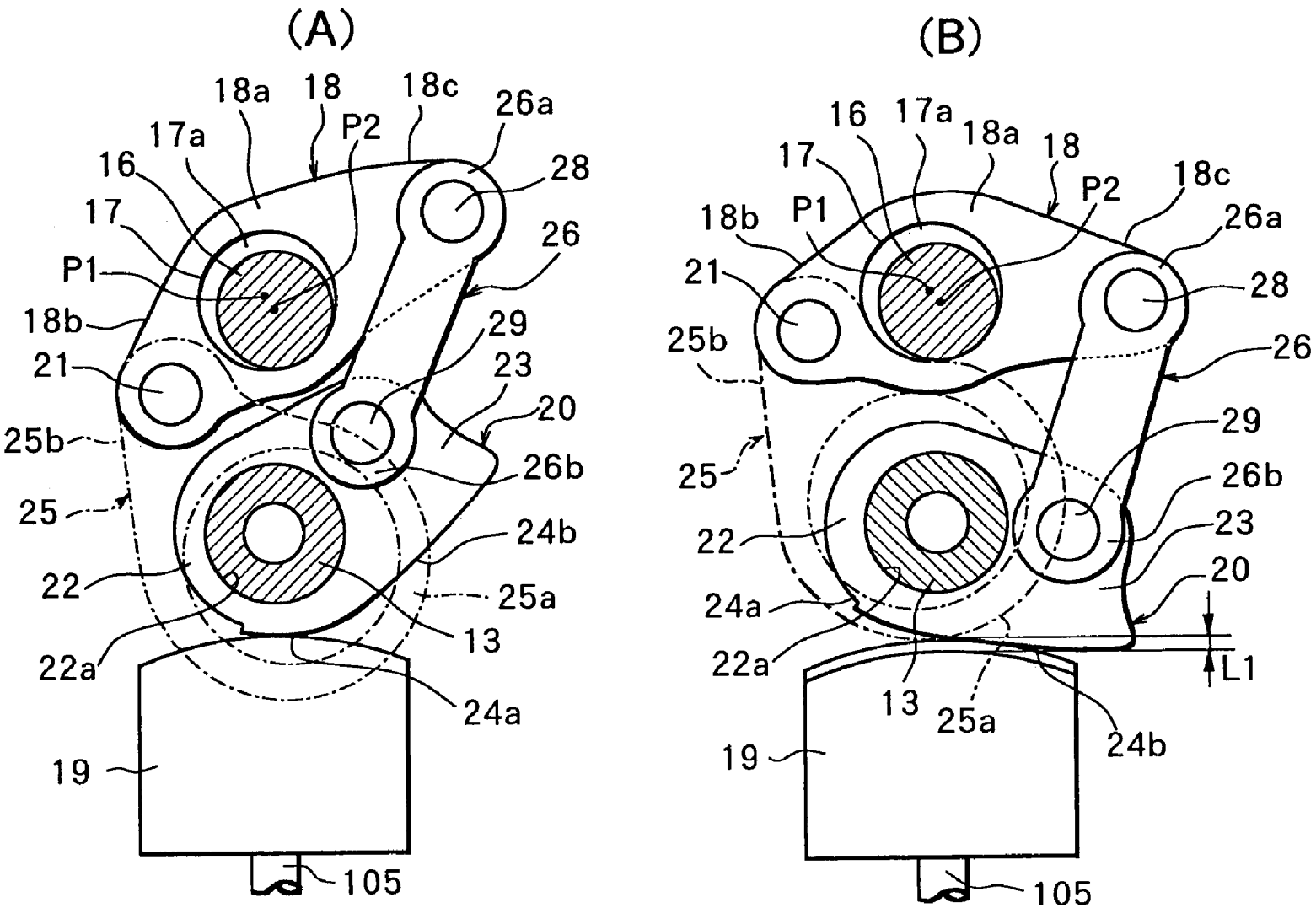
FIGS. 6A and 6B are cross section views showing the variable valve event and lift mechanism at a low lift condition (B—B cross section view of FIG. 3).
Figure 7:
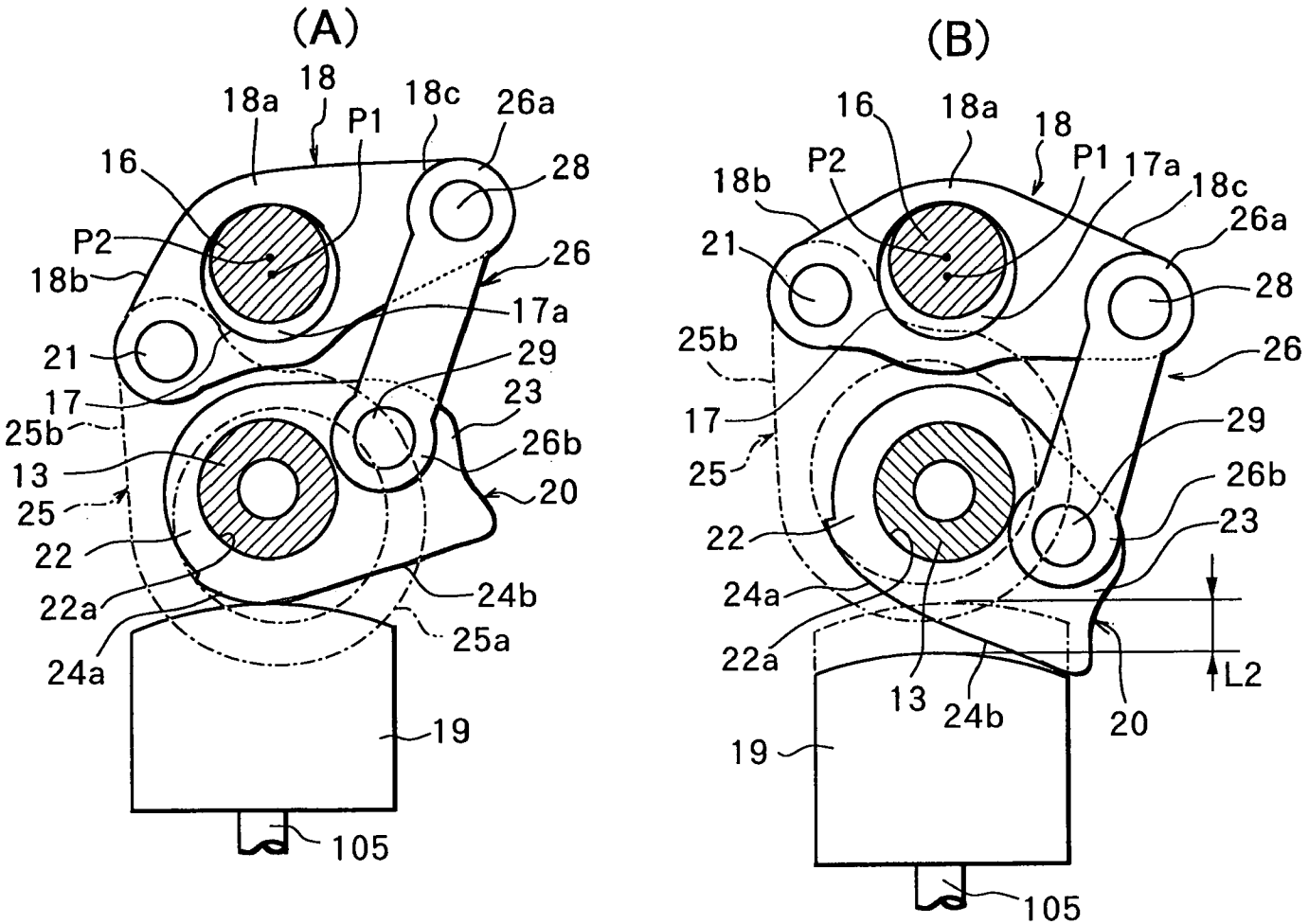
FIGS. 7A and 7B are cross section views showing the variable valve event and lift mechanism at a high lift condition (B—B cross section view of FIG. 3).

Swing cam 20 is formed in a substantially lateral U-shape as shown in FIG. 2, FIG. 6 and FIG. 7, and a supporting hole 22*a* is formed through a substantially ring-shaped base end portion 22. Camshaft 13 is inserted into supporting hole 22*a* to be rotatably supported. Also, a pin hole 23*a* is formed through an end portion 23 positioned at the other end portion 18*c* side of rocker arm 18.

A base circular surface 24*a* of base end portion 22 side and a cam surface 24*b* extending in an arc shape from base circular surface 24*a* to an edge of end portion 23, are formed on a bottom surface of swing cam 20. Base circular surface 24*a* and cam surface 24*b* are in contact with a predetermined position of an upper surface of each valve lifter 19 corresponding to a swing position of swing cam 20.

Figure 8:
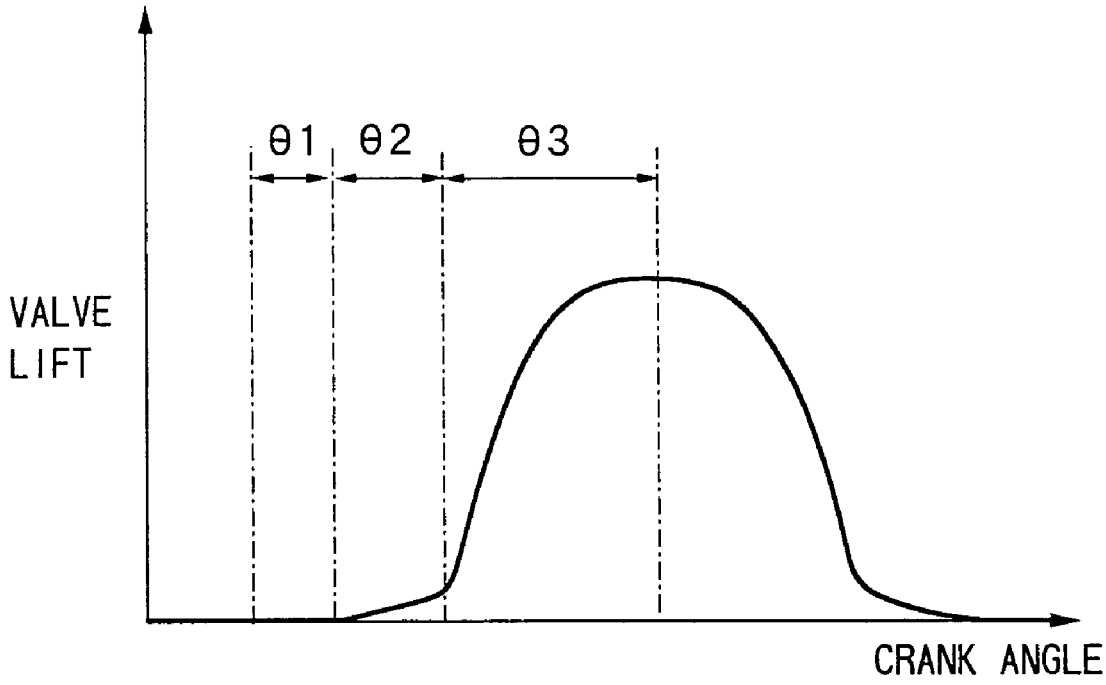
FIG. 8 is a graph showing a valve lift characteristic of the variable valve event and lift mechanism.

Namely, according to a valve lift characteristic shown in FIG. 8, as shown in FIG. 2, a predetermined angle range $\theta 1$ of base circular surface 24*a* is a base circle interval and a range of from base circle interval $\theta 1$ of cam surface 24*b* to a predetermined angle range $\theta 2$ is a so-called ramp interval, and a range of from ramp interval $\theta 2$ of cam surface 24*b* to a predetermined angle range $\theta 3$ is a lift interval.

Link arm 25 includes a ring-shaped base portion 25*a* and a protrusion end 25*b* protrudingly formed on a predetermined position of an outer surface of base portion 25*a*. A fitting hole 25*c* to be rotatably fitted with the outer surface of cam body 15*a* of eccentric cam 15 is formed on a central position of base portion 25*a*. Also, a pin hole 25*d* into which pin 21 is rotatably inserted is formed through protrusion end 25*b*.

Link arm 25 and eccentric cam 15 consist a swing-drive member.

Link member 26 is formed in a linear shape of predetermined length and pin insertion holes 26*c*, 26*d* are formed through both circular end portions 26*a*, 26*b*. End portions of pins 28, 29 pressed into pin hole 18*d* of the other end portion 18*c* of rocker arm 18 and pin hole 23*a* of end portion 23 of swing cam 20, respectively, are rotatably inserted into pin insertion holes 26*c*, 26*d*.

Snap rings 30, 31, 32 restricting axial transfer of link arm 25 and link member 26 are disposed on respective end portions of pins 21, 28, 29.

Figure 9:
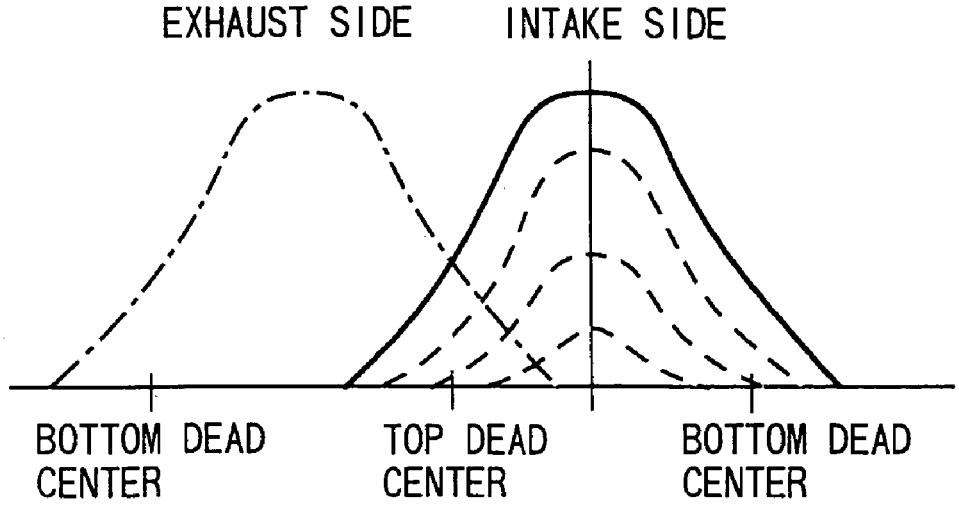
FIG. 9 is a characteristic diagram showing a correlation between a valve lift and an operating angle of the variable valve event and lift mechanism.
Figure 10:
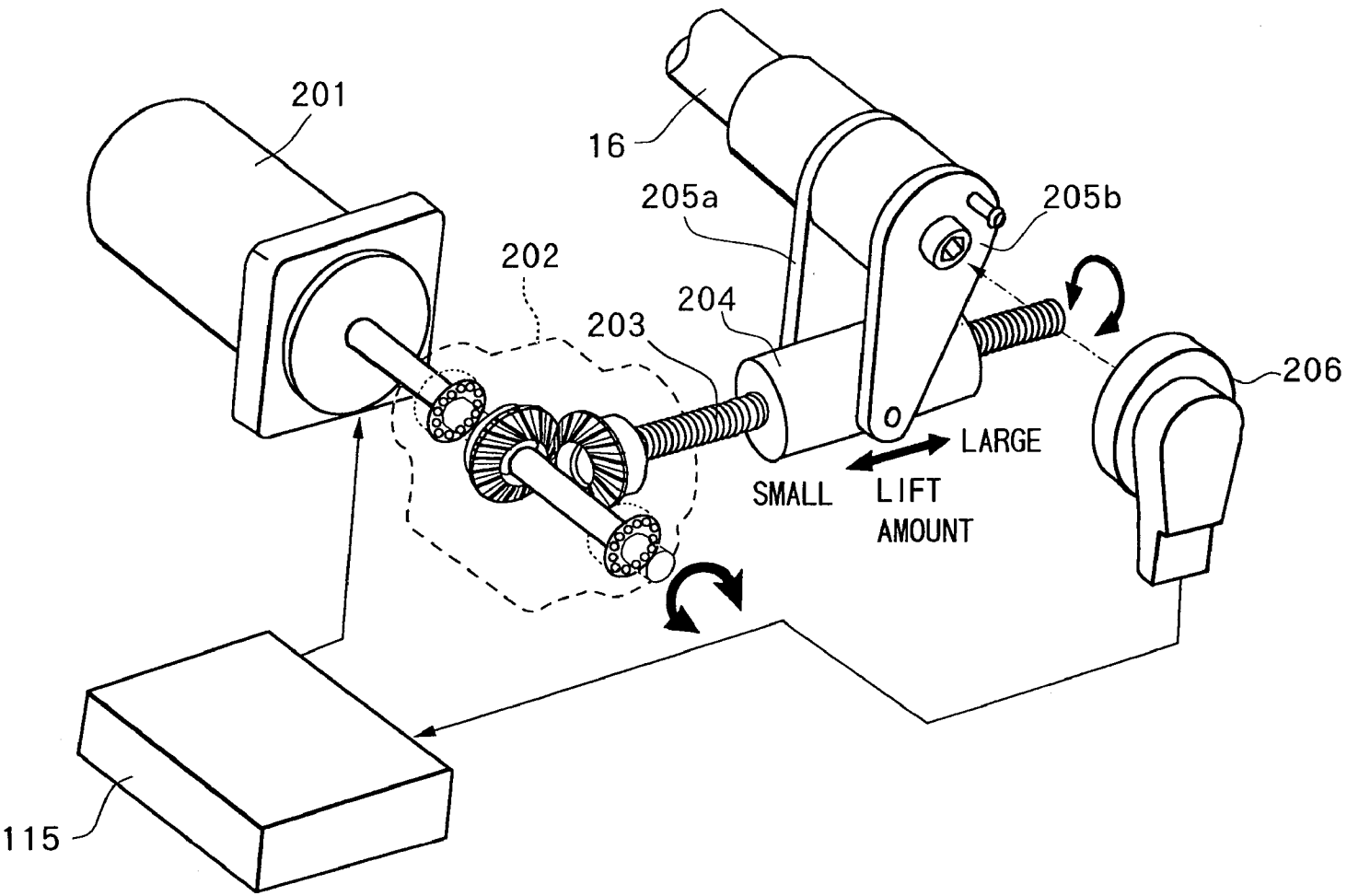
FIG. 10 is a perspective view showing a driving mechanism of a control shaft in the variable valve event and lift mechanism.

Control shaft 16 is driven to rotate within a predetermined angle range by an actuator 201, such as a DC servo motor, disposed on one end portion thereof, as shown in FIG. 10. By varying an angle of control shaft 16 by actuator 201, the valve lift amount and valve operating angle of each of intake valves 105, 105 are successively varied (refer to FIG. 9).

Here, in variable valve event and lift mechanism 112, since the operating angle is fixed mechanically according to the valve lift amount, if the valve lift amount is varied, the operating angle is also varied with the variation of the valve lift amount.

FIG. 10 shows a rotation driving mechanism of control shaft 16.

In FIG. 10, the rotation of actuator 201 is transmitted to a threaded shaft 203 via a transmission member 202, to change the axial position of a nut 204 through which shaft 203 is inserted.

Control shaft 16 is rotated by a pair of stays 205*a*, 205*b*, each mounted on the tip end of control shaft 16 and one end thereof fixed to nut 204.

In this embodiment, as shown in the figure, the valve lift amount is decreased as the position of nut 204 approaches transmission member 202, while the valve lift amount is increased as the position of nut 204 gets away from transmission member 202.

Further, a potentiometer type angle sensor 206 detecting the angle of control shaft 16 is disposed on the tip end of control shaft 16. Control unit 115 feedback controls actuator 201 so that an actual angle of control shaft 16 detected by angle sensor 206 coincides with a target angle.

Note, the valve lift and the operating angle are increased as the angle of control shaft 16 is increased.

Next, the structure of variable valve timing mechanism 114 will be described based on FIG. 11.

Figure 11:
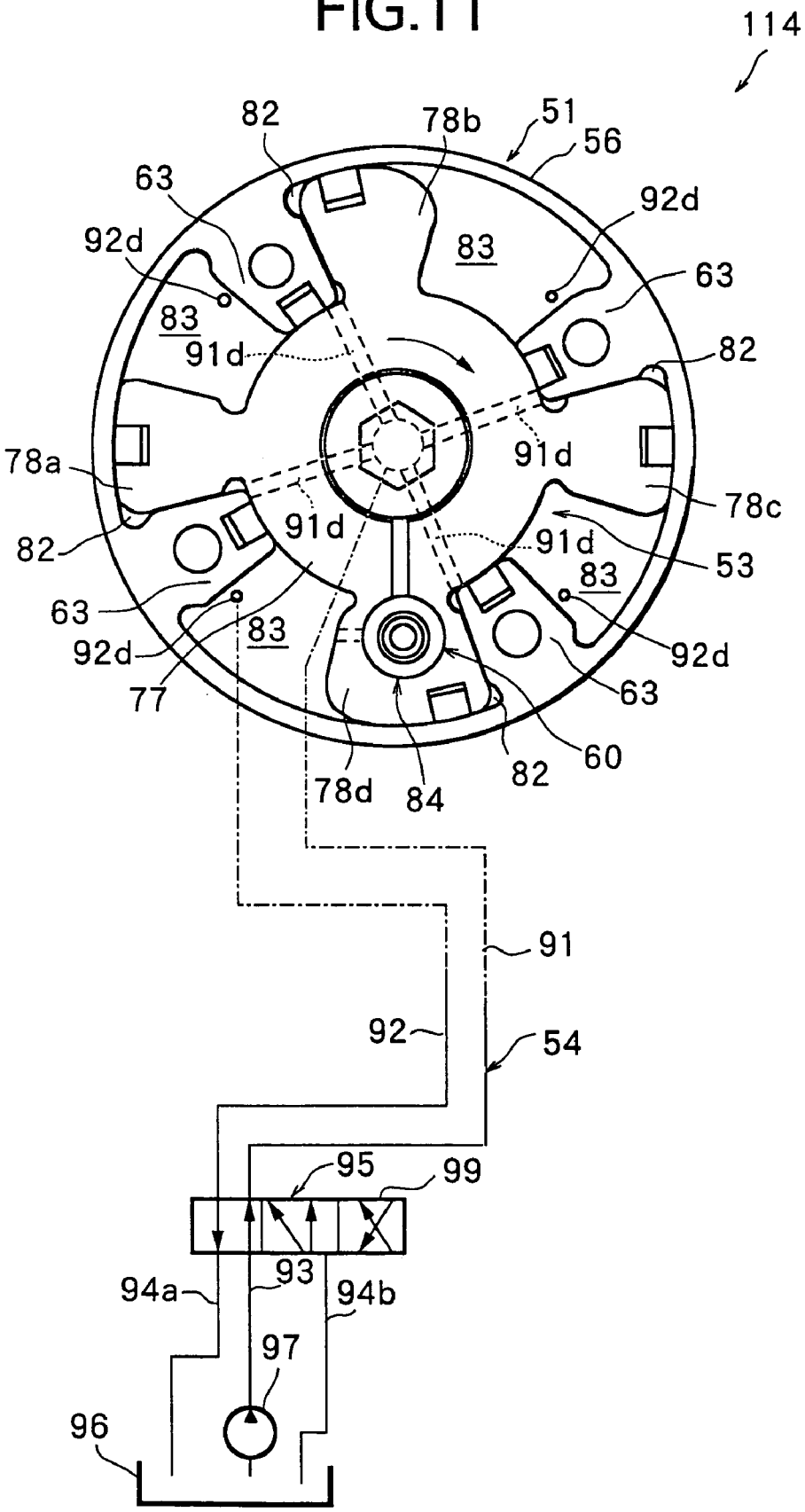
FIG. 11 is a longitudinal cross section view of a variable valve timing mechanism in the embodiment.

Note, variable valve timing mechanism 114 is not limited to the one in FIG. 11, and may be of the constitution to successively vary a rotation phase of a camshaft relative to a crankshaft.

Variable valve timing mechanism 114 in this embodiment is a vane type variable valve timing mechanism, and comprises: a cam sprocket 51 (timing sprocket) which is rotatably driven by a crankshaft 120 via a timing chain; a rotation member 53 secured to an end portion of intake side camshaft 113 and rotatably housed inside cam sprocket 51; a hydraulic circuit 54 that relatively rotates rotation member 53 with respect to cam sprocket 51; and a lock mechanism 60 that selectively locks a relative rotation position between cam sprocket 51 and rotation member 53 at predetermined positions.

Cam sprocket 51 comprises: a rotation portion (not shown in the figure) having on an outer periphery thereof, teeth for engaging with timing chain (or timing belt); a housing 56 located forward of the rotation portion, for rotatably housing rotation member 53; and a front cover and a rear cover (not shown in the figure) for closing the front and rear openings of housing 56.

Housing 56 presents a cylindrical shape formed with both front and rear ends open and with four partition portions 63 protrudingly provided at positions on the inner peripheral face at 90° in the circumferential direction, four partition portions 63 presenting a trapezoidal shape in transverse section and being respectively provided along the axial direction of housing 56.

Rotation member 53 is secured to the front end portion of intake side camshaft 113 and comprises an annular base portion 77 having four vanes 78*a*, 78*b*, 78*c*, and 78*d* provided on an outer peripheral face of base portion 77 at 90° in the circumferential direction.

First through fourth vanes 78*a* to 78*d* present respective cross-sections of approximate trapezoidal shapes. The vanes are disposed in recess portions between each partition portion 63 so as to form spaces in the recess portions to the front and rear in the rotation direction. Advance angle side hydraulic chambers 82 and retarded angle side hydraulic chambers 83 are thus formed.

Lock mechanism 60 has a construction such that a lock pin 84 is inserted into an engagement hole (not shown in the figure) at a rotation position (in the reference operating condition) on the maximum retarded angle side of rotation member 53.

Hydraulic circuit 54 has a dual system oil pressure passage, namely a first oil pressure passage 91 for supplying and discharging oil pressure to advance angle side hydraulic chambers 82, and a second oil pressure passage 92 for supplying and discharging oil pressure to retarded angle side hydraulic chambers 83. To these two oil pressure passages 91 and 92 are connected a supply passage 93 and drain passages 94*a* and 94*b*, respectively, via an electromagnetic switching valve 95 for switching the passages.

An engine driven oil pump 97 for pumping oil in an oil pan 96 is provided in supply passage 93, and the downstream ends of drain passages 94*a* and 94*b* are communicated with oil pan 96.

First oil pressure passage 91 is formed substantially radially in base 77 of rotation member 53, and connected to four branching paths 91*d* communicating with each advance angle side hydraulic chamber 82. Second oil pressure passage 92 is connected to four oil galleries 92*d* opening to each retarded angle side hydraulic chamber 83.

With electromagnetic switching valve 95, an internal spool valve is arranged so as to control relatively the switching between respective oil pressure passages 91 and 92, and supply passage 93 and drain passages 94*a* and 94*b*.

Control unit 115 controls the power supply quantity for an electromagnetic actuator 99 that drives electromagnetic switching valve 95, based on a duty control signal superimposed with a dither signal.

For example, when a control signal of duty ratio 0% is output to electromagnetic actuator 99, the hydraulic fluid pumped from oil pump 97 is supplied to retarded angle side hydraulic chambers 83 via second oil pressure passage 92, and the hydraulic fluid in advance angle side hydraulic chambers 82 is discharged into oil pan 96 from first drain passage 94*a* via first oil pressure passage 91.

Consequently, an inner pressure of retarded angle side hydraulic chambers 83 becomes high while an inner pressure of advance angle side hydraulic chambers 82 becomes low, and rotation member 53 is rotated to the most retarded angle side by means of vanes 78*a* to 78*d*. The result of this is that a valve opening period (opening timing and closing timing) of intake valve 105 is delayed.

On the other hand, when a control signal of duty ratio 100% is output to electromagnetic actuator 99, the hydraulic fluid is supplied to inside of advance angle side hydraulic chambers 82 via first oil pressure passage 91, and the hydraulic fluid in retarded angle side hydraulic chambers 83 is discharged to oil pan 96 via second oil pressure passage 92, and second drain passage 94*b*, so that the inner pressure of retarded angle side hydraulic chambers 83 become low.

Therefore, rotation member 53 is rotated to the full to the advance angle side by means of vanes 78*a* to 78*d*. Due to this, the opening period (opening timing and closing timing) of intake valve 105 is advanced.

Note, variable valve timing mechanism 114 is not limited to the above vane type mechanism, and may be of the constitution as disclosed in Japanese Unexamined Patent Publication Nos. 2001-041013 and 2001-164951 in which a rotation phase of a camshaft relative to a crankshaft is changed by friction braking of an electromagnetic clutch (electromagnetic brake), or of the constitution as disclosed in Japanese Unexamined Patent Publication No. 9-195840 in which a helical gear is operated by a hydraulic pressure.

Next, there will be described controls of variable valve event and lift mechanism 112 and variable valve timing mechanism 114, by control unit 115, referring to flowcharts of FIG. 12 to FIG. 14.

Figure 12:
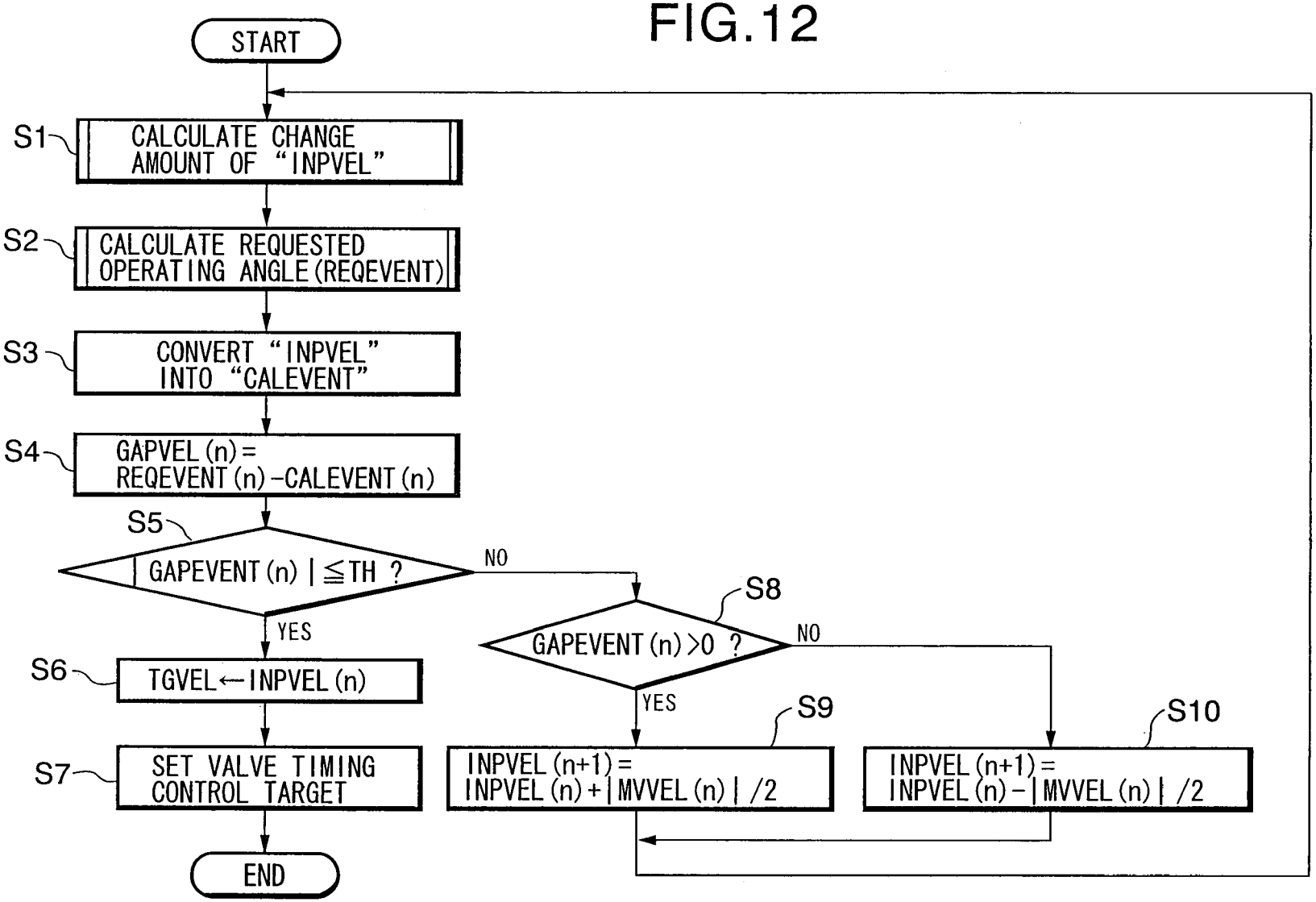
FIG. 12 is a flowchart showing the calculation of desired values of the variable valve event and lift mechanism and the variable valve timing mechanism in the embodiment.
Figure 13:
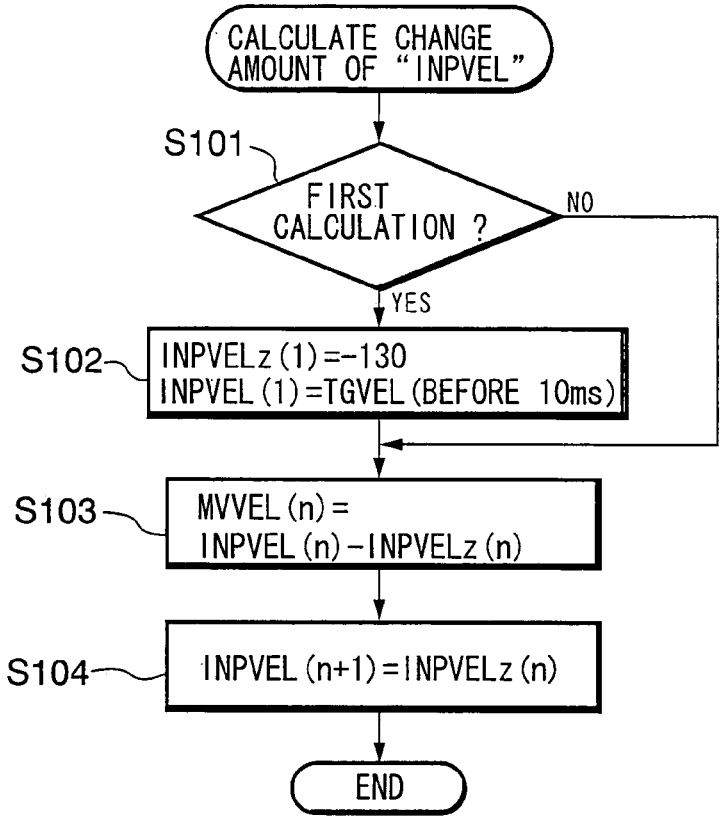
FIG. 13 is a flowchart showing the calculation of a change amount in controlled variable of the variable valve event and lift mechanism in the embodiment.

A control in the flowchart of FIG. 12 is executed at each predetermined minute time (for example, 10 msec).

At first, in step S1, a change amount of an angle INPVEL of control shaft 16, which is set for calculating requested opening timing and requested closing timing of intake valve 105, is calculated.

The process in step S1 will be described in detail in accordance with the flowchart of FIG. 13.

In step S101, it is judged whether or not it is a first time of the calculation. If it is the first time of the calculation, control proceeds to step S102.

In step S102, a predetermined value (for example, −130) stored beforehand in a previous angle INPVELz(1).

Further, a previous value of target angle TGVEL of control shaft 16 in variable valve event and lift mechanism 112 is set to an angle INPVEL(1).

Note, "n" in the angles INPVELz(n) and INPVEL(n) denotes the repetition frequency of processes.

In step S103, a change amount MWEL(n) of the angle INPVEL is calculated in accordance with the following equation.

$$MWEL(n)=INPVEL(n)-INPVELz(n)$$

In step S104, the angle INPVEL(n) used for the calculation of the change amount MWEL(n) in step S103 is set to INPVELz(n+1).

If the change amount MWEL(n) is calculated in the above manner in step S1, then in step S2, an operating angle REQEVENT requested to intake valve 105 for realizing a target residual gas rate and a target intake air amount is calculated.

The process in step S2 will be described in detail in accordance with the flowchart of FIG. 14.

In step S201, the requested closing timing of intake valve is calculated.

Figure 15:
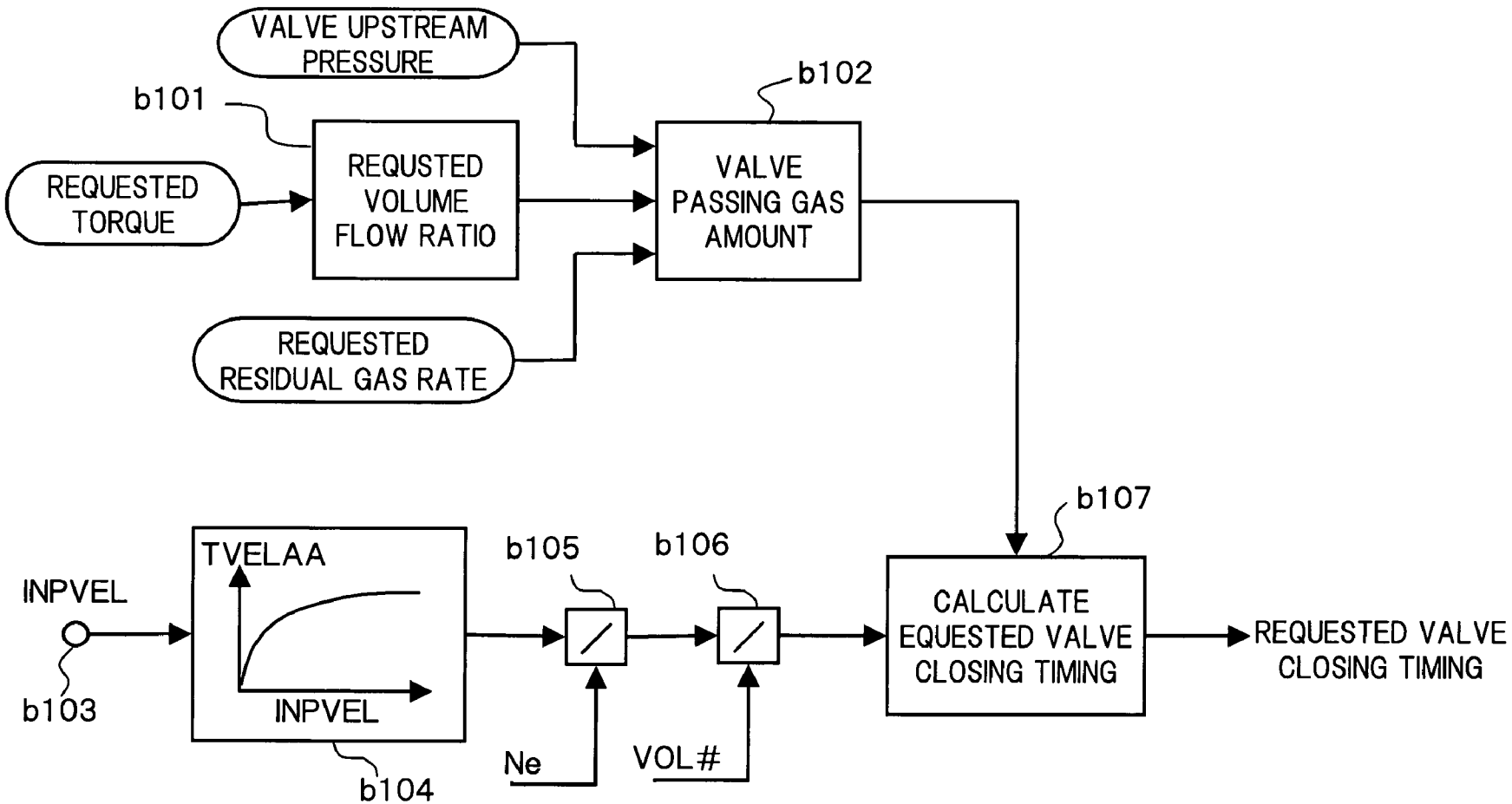
FIG. 15 is a block diagram showing the calculation of requested closing timing of an intake valve in the embodiment.

The requested closing timing is calculated as shown in a block diagram of FIG. 15.

In FIG. 15, a requested engine torque calculated based on the accelerator opening and the like is converted into a requested volume flow ratio TQHOST (target intake air amount) in b101.

In b102, a requested value of a gas amount passing through intake valve 105 is calculated based on the requested volume flow ratio TQHOST, an intake negative pressure and a requested residual gas rate.

In b103, the angle INPVEL(n) is input.

In b104, the angle INPVEL(n) is converted into an opening area TVELM of intake valve 105.

The opening area TVELAA is divided by the engine rotation number (rpm) at the time in b105.

In b106, an output from b105 is divided by a piston displacement VOL# of engine 101, to convert the opening area TVELAA into a state amount AADNV.

Then, in b107, the requested closing timing is calculated based on a correlation between the state amount AADNV and the valve passing gas amount.

Figure 14:
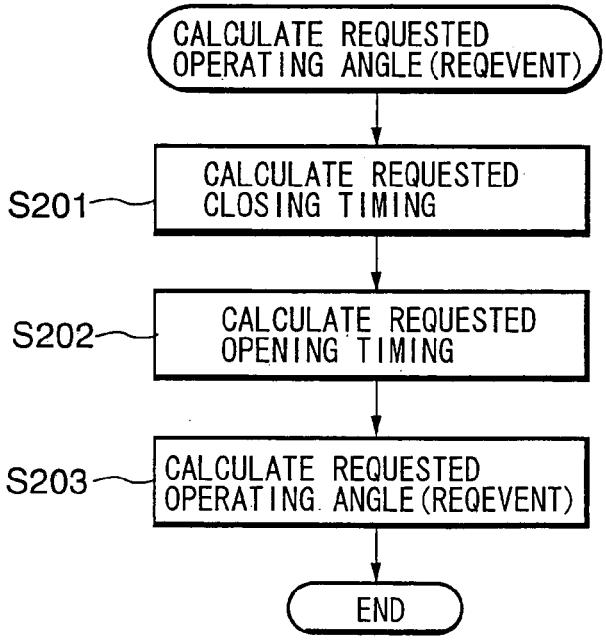
FIG. 14 is a flowchart showing the calculation of a requested operating angle in the embodiment.

Next, in step S202 in the flowchart of FIG. 14, requested opening timing of intake valve 105 is calculated.

Figure 16:
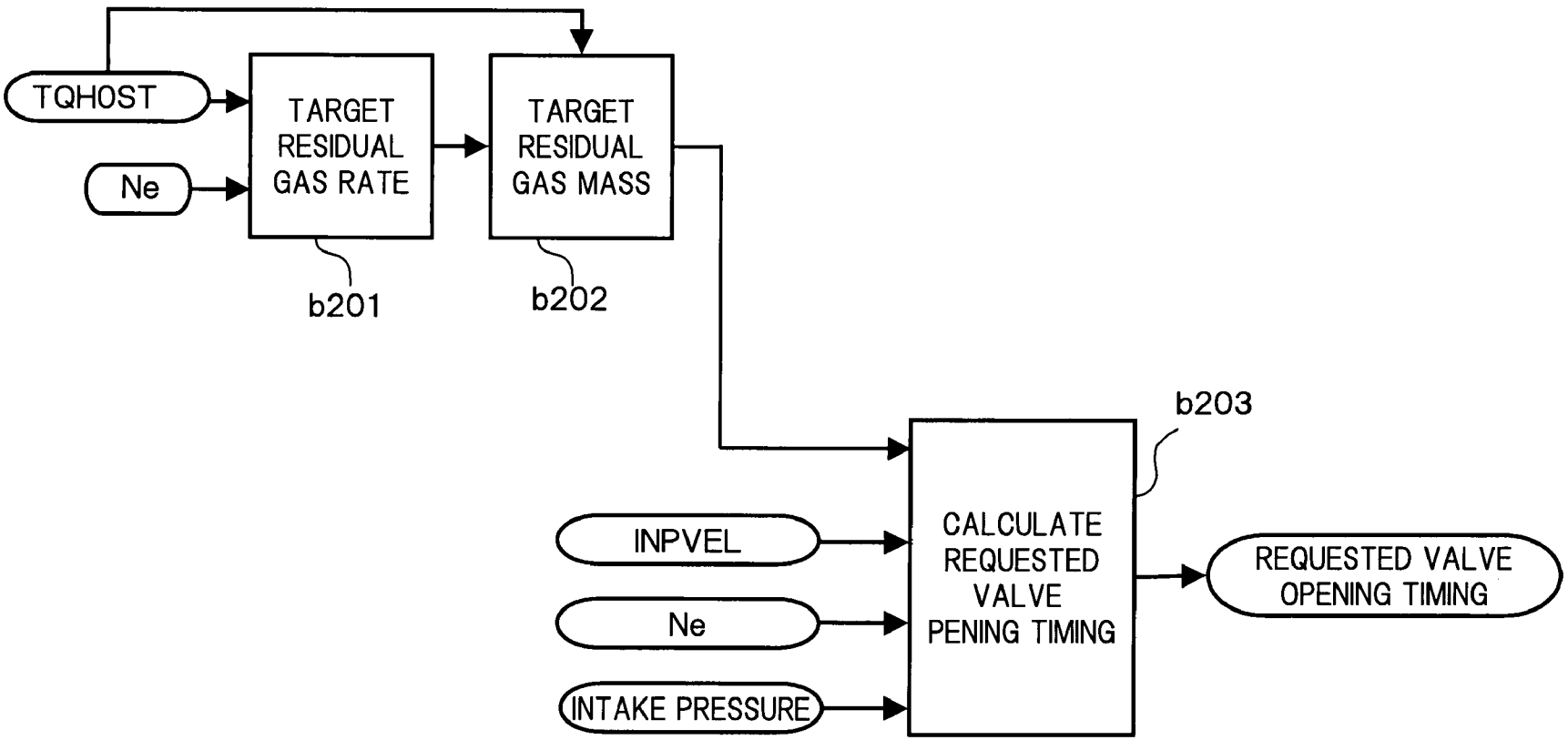
FIG. 16 is a block diagram showing the calculation of requested opening timing of the intake valve in the embodiment.

The requested opening timing is calculated as shown in a block diagram of FIG. 16.

In FIG. 16, in b201, the target residual gas rate is set based on the requested volume flow ratio TQHOST and the engine rotation speed Ne.

In b202, target residual gas mass is calculated based on the target residual gas rate and the requested volume flow ratio TQHOST.

Then, in b203, the requested opening timing of intake valve 105 is calculated based on the target residual gas mass, the engine rotation speed Ne, an intake pressure and further the angle INPVEL(n).

If the requested closing timing for obtaining the target intake air amount and the requested opening timing for obtaining the target residual gas rate are calculated in the above manner, then in step S203 of FIG. 14, the requested operating angle REQEVENT(n) is calculated based on the requested closing timing and the requested opening timing.

The requested operating angle REQEVENT(n) is calculated as a crank angle of from the requested opening timing to the requested closing timing.

If the requested operating angle REQEVENT(n) is calculated in the above manner in step S2 of the flowchart of FIG. 12, then control proceeds to step S3.

Figure 17:
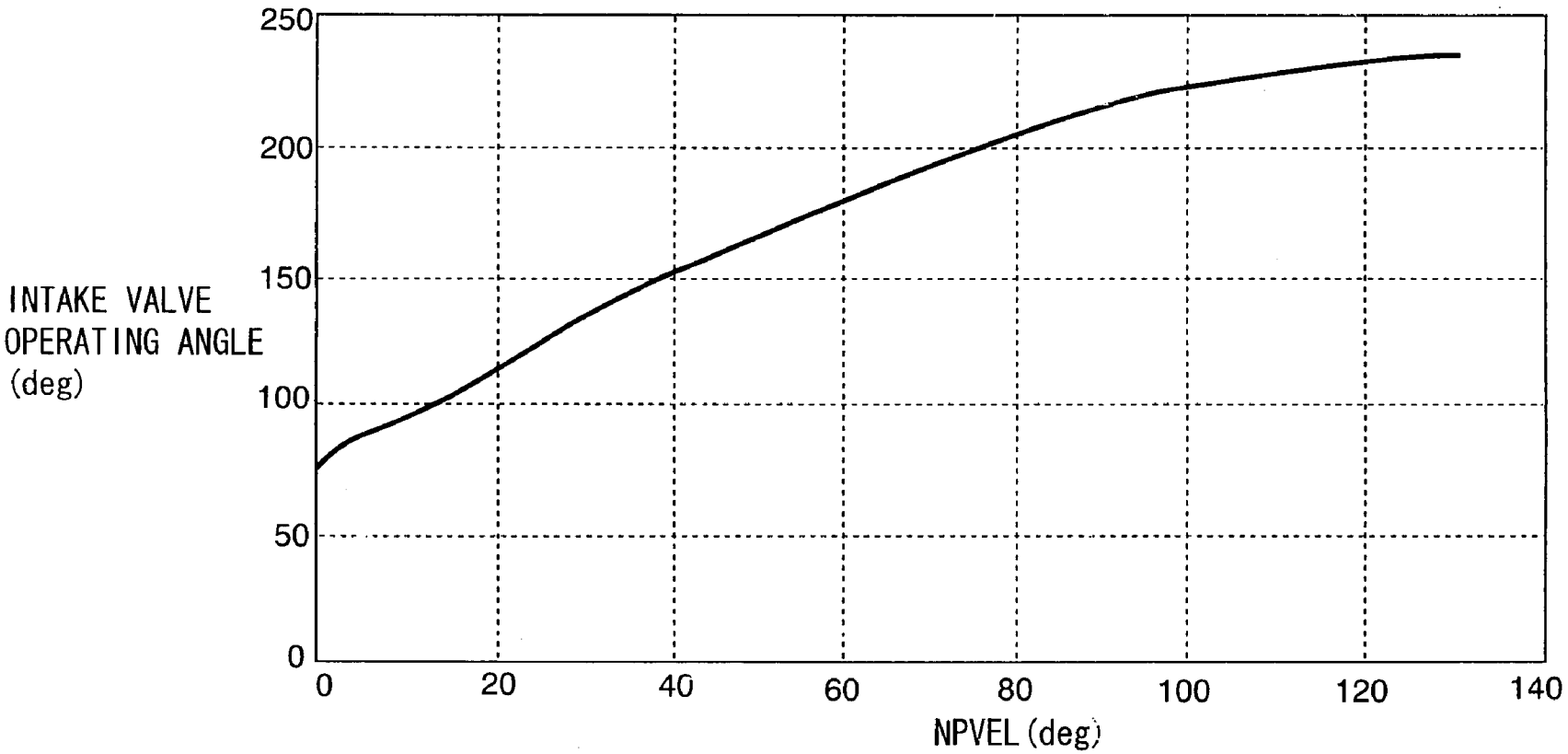
FIG. 17 is a graph showing a correlation between the controlled variable of the variable valve event and lift mechanism and the operating angle of the intake valve.

In step S3, an operating angle CALEVENT(n) corresponding to the angle INPVEL(n) is obtained by referring to a table as shown in FIG. 17.

In step S4, a deviation GAPVEL(n) between REQEVENT(n) and CALEVENT(n) is calculated.

$$GAPVEL(n)=REQEVENT(n)-CALEVENT(n)$$

In the case where REQEVENT(n) and CALEVENT(n) coincide with each other, the angle INPVEL(n) is set to a desired value of variable valve event and lift mechanism 112, so that the target intake air amount and the target residual gas rate can be realized.

On the other hand, in the case where REQEVENT(n) and CALEVENT(n) differ from each other, even if the angle INPVEL(n) is set to the desired value of variable valve event and lift mechanism 112, it is impossible to realize the target intake air amount and the target residual gas rate.

Therefore, in step S5, it is judged whether or not an absolute value of the deviation GAPVEL(n) is equal to or less than a predetermined value TH.

Then, it is judged whether or not the target intake air amount and the target residual gas rate can be realized when the angle INPVEL(n) is set to the desired value of variable valve event and lift mechanism 112.

Note, the predetermined value TH is set to a value the same as the resolution of the angle of control shaft 16 (for example, 0.5 deg).

If the absolute value of the deviation GAPVEL(n) is equal to or less than the predetermined value TH, the angle INPVEL(n) is set just as it is to the desired value TGVEL of variable valve event and lift mechanism 112, so that the target intake air amount and the target residual gas rate can be realized.

Therefore, when the absolute value of the deviation GAPVEL(n) is equal to or less than the predetermined value TH, control proceeds to step S6, in which the angle INPVEL (n) is set just as it is to the desired value TGVEL of variable valve event and lift mechanism 112.

Further, in step S7, a desired value TGVTC of variable valve timing mechanism 114 is set so as to realize the requested closing timing and the requested opening timing at the operating angle in the desired value TGVEL.

On the other hand, in the case where the absolute value of the deviation GAPVEL(n) exceeds the predetermined value TH, control proceeds to step S8.

In step S8, it is judged whether or not the deviation GAPVEL(n)>0.

In the case where the deviation GAPVEL(n) is a positive value and the requested operating angle REQEVENT(n) is larger than the operating angle CALEVENT(n) corresponding to the angle INPVEL(n) at the time, control proceeds to step S9.

In step S9, the angle INPVEL(n) is updated in accordance with the following equation.

$$INPVEL(n+1)=INPVEL(n)+|MIWEL(n)|/2$$

Namely, if the requested operating angle REQEVENT(n) is larger than the operating angle CALEVENT(n), the angle INPVEL is increased by the half of a previous change amount MVVEL(n).

Further, if the requested operating angle REQEVENT(n) is smaller than the operating angle CALEVENT(n) and it is judged in step S8 that the deviation GAPVEL(n) is a negative value, control proceeds to step S10.

In step S10, the angle INPVEL(n) is calculated in accordance with the following equation.

$$INPVEL(n+1)=INPVEL(n)-|MVVEL(n)|/2$$

Namely, if the requested operating angle REQEVENT(n) is smaller than the operating angle CALEVENT(n), the angle INPVEL is decreased by the half of the previous change amount MWEL(n).

When the angle INPVEL is updated in step S9 or in step S10, then control returns step S1.

Figure 18:
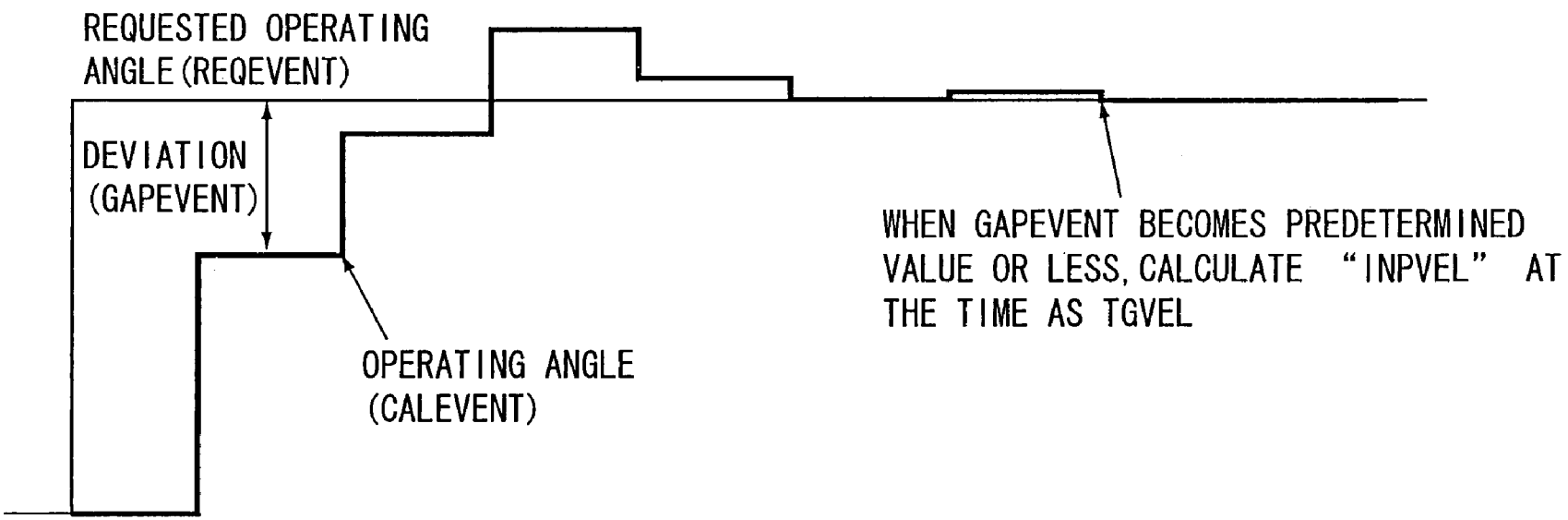
FIG. 18 is a time chart showing a correlation between the requested operating angle and an operating angle being a basis of the requested operating angle in the embodiment.

Then, the requested opening timing and the requested closing timing are calculated based on the updated angle INPVEL, and the calculations in steps S1 to S5 and in steps S8 to S9 are repetitively performed until the absolute value of the deviation between the requested operating angle REQEVENT(n) based on the requested opening timing and the requested closing timing, and the operating angle CALEVENT corresponding to the angle INPVEL reaches the predetermined value TH or less (refer to FIG. 18).

In FIG. 18, in order to easily understand a change in the operating angle CALEVENT due to the update of the angle INPVEL, the requested operating angle REQEVENT is indicated as being fixed. However, actually, the requested operating angle REQEVENT is also changed with the change in the angle INPVEL.

According to the above constitution, since it is not necessary that the angle INPVEL is set in detail to calculate the requested opening timing, the requested closing timing and the requested operating angle REQEVENT(n) corresponding to these timing for each angle INPVEL, it is possible to reduce the calculation work.

Moreover, by changing the angle INPVEL by a predetermined rate of the previous change amount MVVEL(n), it is possible to largely change the angle INPVEL toward an optimum value at first, and then, as the angle INPVEL approaching the optimum value, to minutely change the angle INPVEL. Thus, it is possible to reduce the frequency of calculations and also to realize the target intake air amount and the target residual gas rate with high accuracy.

Note, it is apparent that the stepwise change amount used for the update of the angle INPVEL is not limited to the half of the previous change amount MVVEL(n).

Further, the calculation method of the requested closing timing based on the target intake air amount and the calculation method of the requested opening timing based on the target residual gas rate are not limited to those shown in block diagrams of FIG. 15 and FIG. 16, respectively.

The entire contents of Japanese Patent Application No. 2002-351565, filed Dec. 3, 2002, a priority of which is claimed, are incorporated herein by reference.

While only selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined by the appended claims and their equivalents.

What is claimed are:

1. A variable valve control apparatus for an internal combustion engine provided with a variable valve event and lift mechanism that successively varies an operating angle and a valve lift of an intake valve of the internal combustion engine, comprising:

a first calculating section that calculates requested opening timing and requested closing timing of said intake valve provided that controlled variable of said variable valve event and lift mechanism is a predetermined value;

a second calculating section that calculates a requested operating angle based on said requested opening timing and said requested closing timing;

a third calculating section that calculates a deviation between an operating angle corresponding to said controlled variable, and said requested operating angle;

an updating section that updates said controlled variable according to said deviation until an absolute value of said deviation reaches a predetermined value or less, and executes the calculations in said first to third calculating sections repetitively based on the post-updated controlled variable;

a setting section that sets said controlled variable of the time when the absolute value of said deviation is the predetermined value or less, to a desired value; and a control section that controls said variable valve event and lift mechanism based on said desired value.

2. A variable valve control apparatus for an internal combustion engine according to claim 1, wherein said first calculating section calculates closing timing of said intake valve at which a target intake air amount can be obtained when said controlled variable is the predetermined value, as said requested closing timing.

3. A variable valve control apparatus for an internal combustion engine according to claim 1, wherein said first calculating section calculates opening timing of said intake valve at which a target residual gas rate can be obtained when said controlled variable is the predetermined value, as said requested opening timing.

4. A variable valve control apparatus for an internal combustion engine according to claim 1, wherein said updating section determines whether said controlled variable is to be increased or to be decreased depending on whether said deviation is a positive value or a negative value.

5. A variable valve control apparatus for an internal combustion engine according to claim 1, wherein said updating section decreases in stepwise an amount for changing said controlled variable.

6. A variable valve control apparatus for an internal combustion engine according to claim 5, wherein said updating section changes said controlled variable by a predetermined rate of a previous change amount of said controlled variable.

7. A variable valve control apparatus for an internal combustion engine according to claim 1, wherein said updating section sets the controlled variable set as the desired value by said setting section, as an initial value, to update the controlled variable.

8. A variable valve control apparatus for an internal combustion engine according to claim 1, further comprising:

a variable valve timing mechanism that successively varies a center phase of the operating angle of said intake valve; and a valve timing control section that controls said variable valve timing mechanism so that said intake valve is opened and closed at said requested opening timing and said requested closing timing.

9. A variable valve control apparatus for an internal combustion engine according to claim 1, wherein there is provided a detecting section that detects the controlled variable in said variable valve event and lift mechanism;

said control section comprises a comparison section that compares the controlled variable detected in said detecting section and said desired value, and an operating section that calculates an operating amount based on an output signal from said comparison section to apply said operating amount on said variable valve event and lift mechanism; and a predetermined value to be compared with the absolute value of said deviation is set to a value the same as the resolution in said detecting section.

10. A variable valve control apparatus for an internal combustion engine provided with a variable valve event and lift mechanism that successively varies an operating angle and a valve lift of an intake valve of the internal combustion engine, comprising:

first calculating means for calculating requested opening timing and requested closing timing of said intake valve provided that controlled variable of said variable valve event and lift mechanism is a predetermined value;

second calculating means for calculating a requested operating angle based on said requested opening timing and said requested closing timing;

third calculating means for calculating a deviation between an operating angle corresponding to said controlled variable, and said requested operating angle;

updating means for updating said controlled variable according to said deviation until an absolute value of said deviation reaches a predetermined value or less, and executes the calculations in said first to third calculating means repetitively based on the post-updated controlled variable;

setting means for setting said controlled variable of the time when the absolute value of said deviation is the predetermined value or less, to a desired value; and control means for controlling said variable valve event and lift mechanism based on said desired value.

11. A variable valve control method for an internal combustion engine provided with a variable valve event and lift mechanism that successively varies an operating angle and a valve lift of an intake valve of the internal combustion engine, comprising the steps of:

calculating requested opening timing and requested closing timing of said intake valve provided that controlled variable of said variable valve event and lift mechanism is a predetermined value;

calculating a requested operating angle based on said requested opening timing and said requested closing timing;

calculating a deviation between an operating angle corresponding to said controlled variable, and said requested operating angle;

updating said controlled variable according to said deviation until an absolute value of said deviation reaches a predetermined value or less;

repeating the calculations of said requested opening timing, said requested closing timing and said deviation based on the post-updated controlled variable;

setting said controlled variable of the time when the absolute value of said deviation is the predetermined value or less, to a desired value; and controlling said variable valve event and lift mechanism based on said desired value.

12. A variable valve control method for an internal combustion engine according to claim 11, wherein said step of calculating said requested closing timing comprises the steps of:

calculating a target intake air amount; and calculating closing timing of said intake valve at which said target intake air amount can be obtained when said controlled variable is the predetermined value, as said requested closing timing.

13. A variable valve control method for an internal combustion engine according to claim 11, wherein said step of calculating said requested closing timing comprises the steps of:

calculating a target residual gas rate; and calculating opening timing of said intake valve at which said target residual gas rate can be obtained when said controlled variable is the predetermined value, as said requested opening timing.

14. A variable valve control method for an internal combustion engine according to claim 11, wherein said step of updating said controlled variable comprises the steps of:

judging whether said controlled variable is a positive value or a negative value; and determining whether said controlled variable is to be increased or to be decreased depending on whether said deviation is the positive value or the negative value.

15. A variable valve control method for an internal combustion engine according to claim 11, wherein said step of updating said controlled variable comprises the step of;

decreasing in stepwise an amount for changing said controlled variable.

16. A variable valve control method for an internal combustion engine according to claim 11, wherein said step of updating said controlled variable comprises the steps of:

calculating a previous change amount of said controlled variable;

calculating a predetermined rate of said previous change amount, as a present change amount; and changing said controlled variable based on said present change amount.

17. A variable valve control method for an internal combustion engine according to claim 11, wherein said step of updating said controlled variable comprises the step of;

setting the controlled variable set as the desired value, as an initial value.

18. A variable valve control method for an internal combustion engine according to claim 11, wherein said internal combustion engine comprises a variable valve timing mechanism that successively varies a center phase of the operating angle of said intake valve; and said method further comprises the step of;

controlling said variable valve timing mechanism so that said intake valve is opened and closed at said requested opening timing and said requested closing timing.

19. A variable valve control method for an internal combustion engine according to claim 11, wherein said method further comprises the step of detecting the controlled variable in said variable valve event and lift mechanism, said step of controlling said variable valve event and lift mechanism comprises the steps of:

comparing a detection value of said controlled variable and said desired value;

calculating an operating amount based on said comparison result; and applying said operating amount on said variable valve event and lift mechanism, and a predetermined value to be compared with the absolute value of said deviation is set to a value the same as the detection resolution of said controlled variable.

* * * * *